United States Patent [19]

Bischoff

[11] 4,228,669

[45] Oct. 21, 1980

[54] DOUBLE CYLINDER LOCK WITH KEY RETENTION

[75] Inventor: Daniel R. Bischoff, Grand Rapids, Mich.

[73] Assignee: Kysor Industrial Corporation, Cadillac, Mich.

[21] Appl. No.: 921,442

[22] Filed: Jul. 3, 1978

[51] Int. Cl.[3] ..... E05B 9/10; E05B 11/00; E05B 17/04

[52] U.S. Cl. ..... 70/379 R; 70/134; 70/389; 70/DIG. 42; 70/DIG. 60

[58] Field of Search ..... 70/379 R, 379 A, 380, 70/134, 388, 389, 156, DIG. 60, DIG. 42

[56] References Cited

U.S. PATENT DOCUMENTS

| | | | |
|---|---|---|---|
| 818,719 | 4/1906 | Webb | 70/388 X |
| 1,598,551 | 8/1926 | Brauning | 70/379 R |
| 1,639,535 | 8/1927 | Russo | 70/379 R |
| 2,100,233 | 11/1937 | Beaumont | 70/388 X |
| 2,712,749 | 7/1955 | Quigley et al. | 70/379 R |
| 3,123,995 | 3/1964 | Russell et al. | 70/379 R |
| 3,799,592 | 3/1974 | Babb, Jr. et al. | 292/140 |
| 4,068,510 | 1/1978 | Neary | 70/379 R |
| 4,109,496 | 8/1978 | Allemann et al. | 70/380 |

*Primary Examiner*—Roy D. Frazier
*Assistant Examiner*—Carl F. Pietruska
*Attorney, Agent, or Firm*—Price, Heneveld, Huizenga & Cooper

[57] ABSTRACT

A double cylinder lock constructed with a single tailpiece driver and a clutch. The interior lock key can be extracted only when the lock bolt is retracted and not when the lock bolt is extended. The driver and clutch arrangement prevent either cylinder from becoming out of time, regardless of which cylinder is used to throw the bolt.

6 Claims, 18 Drawing Figures

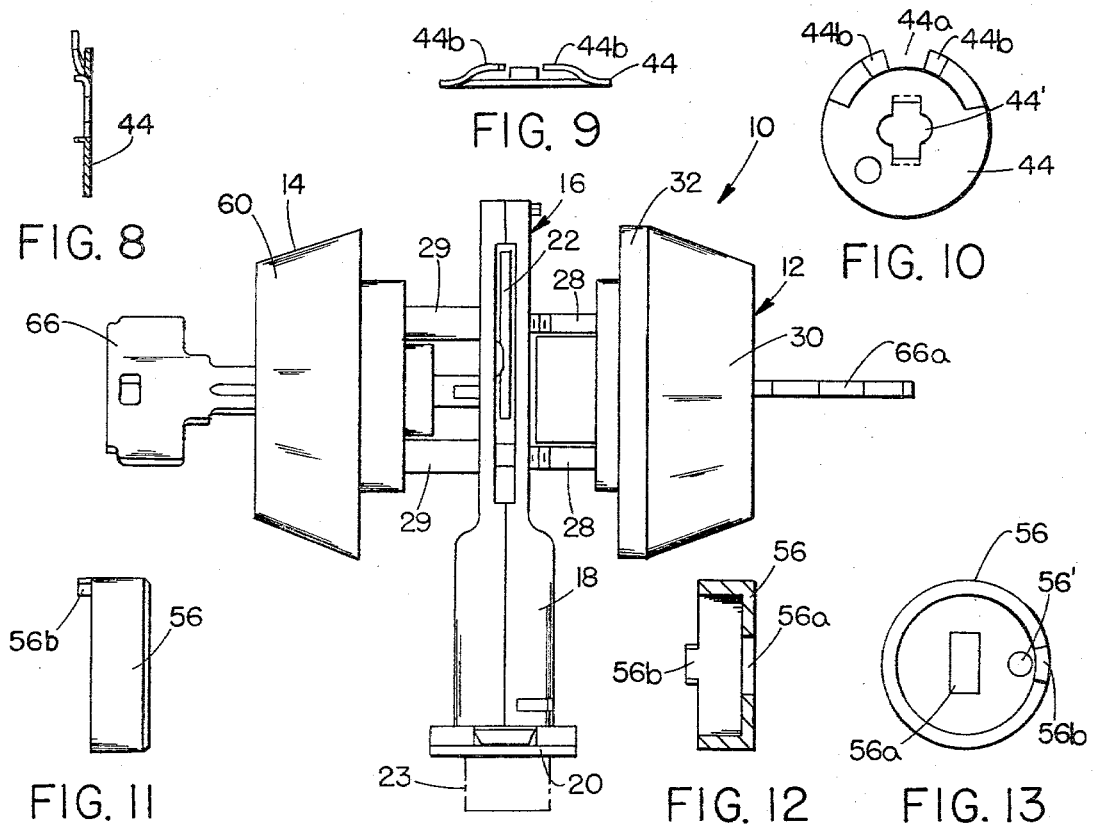
FIG. 8 FIG. 9 FIG. 10 FIG. 11 FIG. 12 FIG. 13
FIG. 1
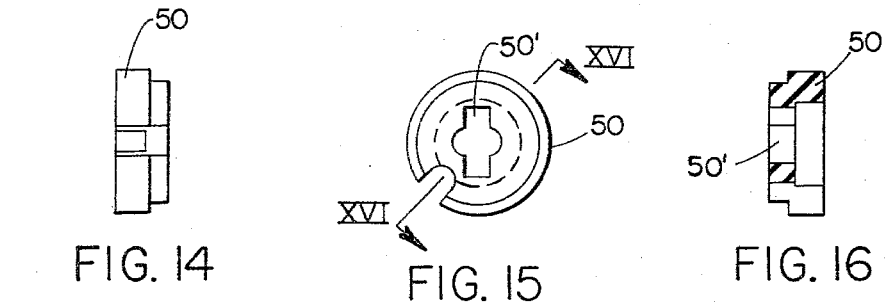
FIG. 14 FIG. 15 FIG. 16
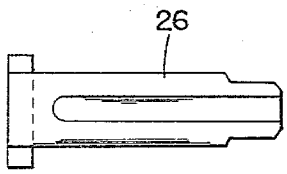
FIG. 17
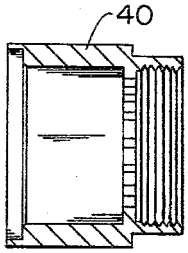
FIG. 18

DOUBLE CYLINDER LOCK WITH KEY RETENTION

BACKGROUND OF THE INVENTION

This invention relates to a double cylinder lock operable by a key from the interior or exterior, the key being retained in the interior cylinder when the lock bolt is extended.

Lock bolts on exterior doors are constructed with either a single lock cylinder or a dobule lock cylinder. A single lock cylinder requires a key to actuate it from the exterior, but allows manual actuation as by a thumb turn at the interior. A double lock cylinder requires a key to actuate it from the interior as well as the exterior. There are environments in which the single lock cylinder is preferable and other environments where the double lock cylinder is preferable. Usually this is determined by the needs of the owner of the premises and/or building code requirements.

Where double cylinder locks are employed, it is desirable and sometimes required that the key not be extractable from the interior cylinder when the lock bolt is extended. This is to assure ready unlocking capacity for rapid exit under panic conditions such as fire.

Achieving a double cylinder lock with interior key retention, which will not go "out of time" and cause inner key retention when unlocked has been a challenge to the trade.

SUMMARY OF THE INVENTION

This invention provides a double cylinder lock with unique construction employing a single driver or tailpiece for both cylinders, combined with a special clutch. Both cylinders are operable upon the single tailpiece, the outer cylinder directly so, and the inner cylinder through the special clutch. The clutch has a spring disc with resilient inherently biased ears achieving selective rotary drive engagement, such that no matter which cylinder was last used to extend or retract the lock bolt, either one can next be employed without the mechanism getting out of time. The insertion of a key into the interior cylinder shifts the clutch mechanism to drive condition with the single tailpiece.

BRIEF DESCRIPTION OF THE DRAWINGS

FIG. 1 is a plan view of a double cylinder lock employing this invention;

FIG. 8 is an elevational sectional view of the spring cam disc forming a component of the clutch mechanism of this double cylinder lock;

FIG. 9 is a plan view of the spring cam;

FIG. 10 is an end elevational view of the spring cam;

FIG. 11 is an elevational view of the spring driver of the clutch mechanism of this lock;

FIG. 12 is a sectional view of the spring driver;

FIG. 13 is an end elevational view of the spring driver;

FIG. 14 is an elevational view of the tailpiece driver bearing;

FIG. 15 is an end elevational view of the tailpiece driver bearing;

FIG. 16 is a sectional view of the tailpiece driver bearing taken on plane XVI—XVI in FIG. 15;

FIG. 17 is an elevational view of the tailpiece; and

FIG. 18 is a sectional elevational view of the barrel cap.

DESCRIPTION OF THE PREFERRED EMBODIMENT

Referring particularly to FIGS. 1–4, the novel double cylinder lock assembly 10 comprises an interior subassembly 12 and an exterior subassembly 14, both cooperative with and astraddle of a deadbolt latch subassembly 16.

Figure 2:
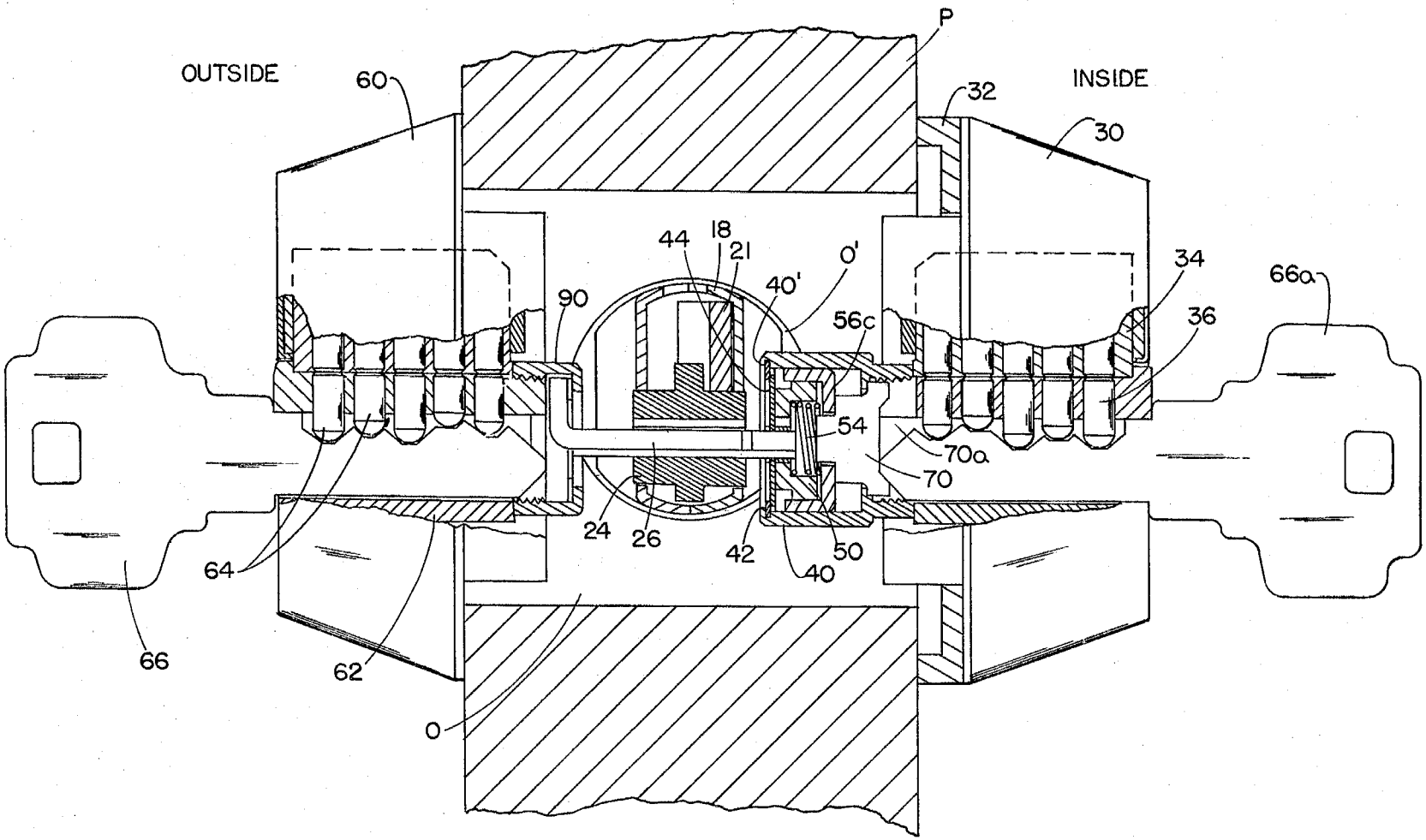
FIG. 2 is an enlarged sectional elevational view of the lock mechanism in FIG. 1, showing the clutch thereof engaged.
Figure 7:
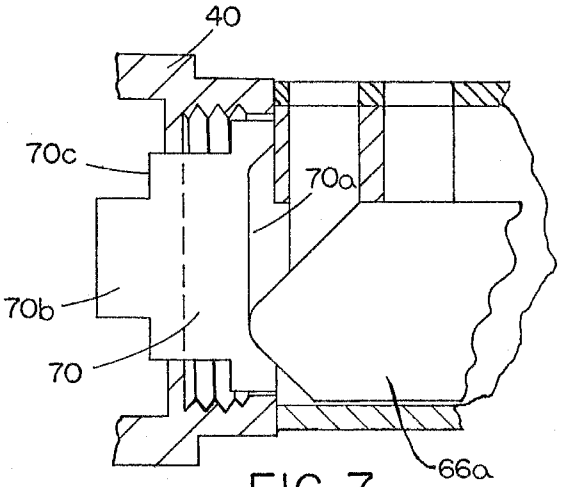
FIG. 7 is an enlarged fragmentary elevational sectional view of the interfitting interior key and driver pusher of this lock.
Figure 6:
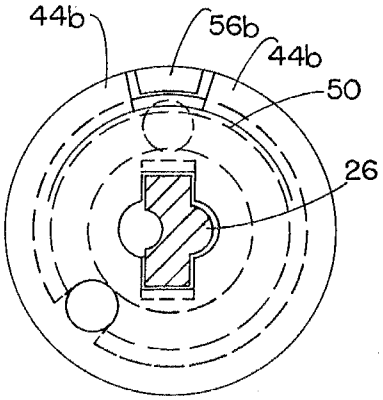
FIG. 6 is a sectional view taken on plane VI—VI of FIG. 3, with the outer barrel cap not depicted.
Figure 5:
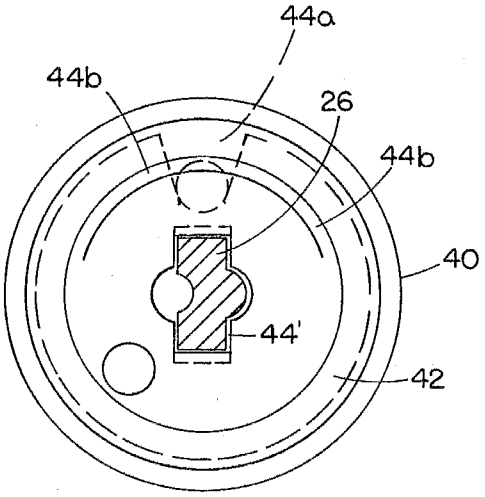
FIG. 5 is a sectional view taken on plane V—V of FIG. 3.
Figure 3:
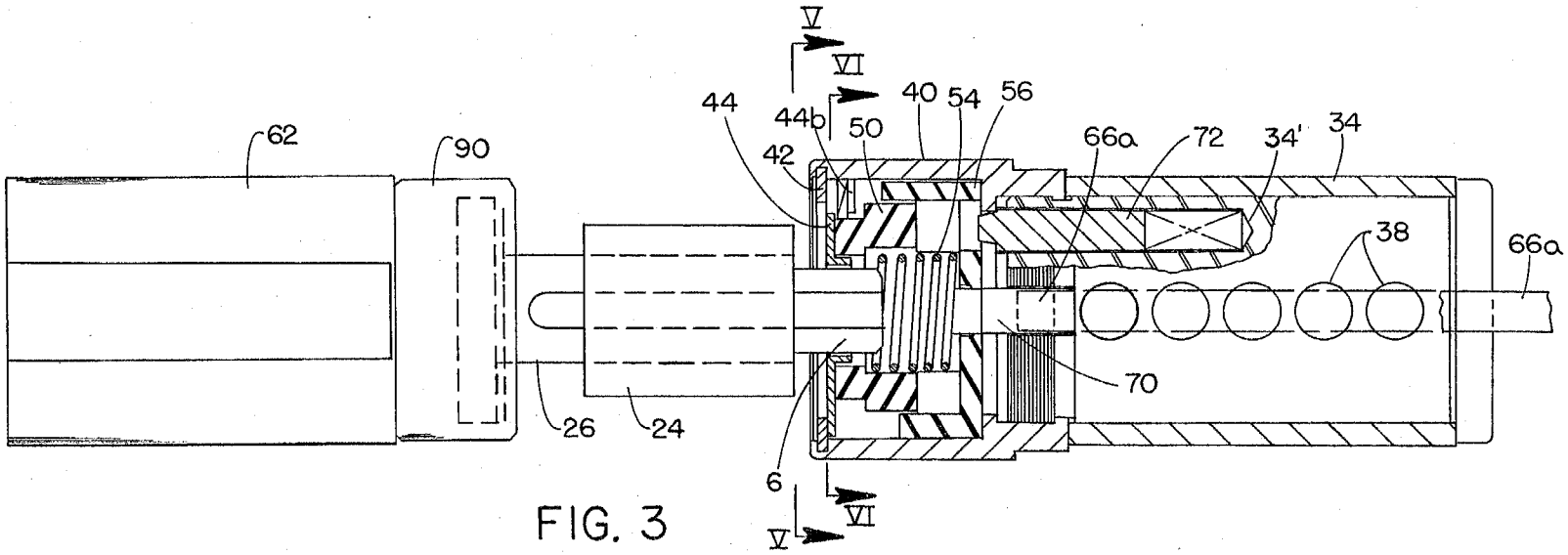
FIG. 3 is an enlarged partially sectional top view of the double cylinder mechanism in FIG. 2 but showing the clutch thereof disengaged.
Figure 4:
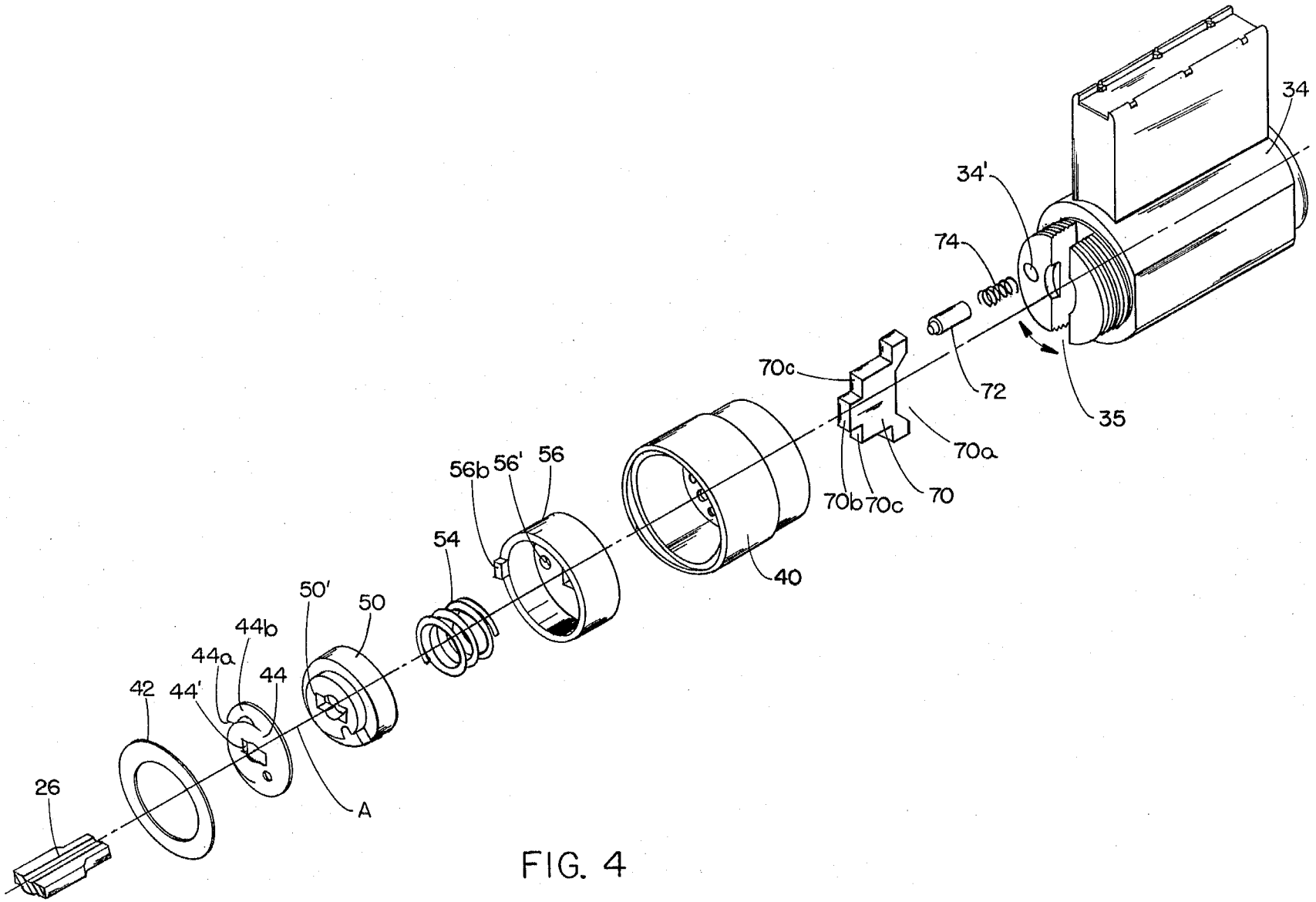
FIG. 4 is a fragmentary exploded perspective view of the interior portion of the double cylinder lock.

The deadbolt latch subassembly 16 itself is of conventional construction, being for example of the type set forth in U.S. Pat. No. 3,799,592. It has a housing 18 containing an extendable-retractable deadbolt 23 (FIG. 1) which can be caused to extend past the mounting plate 20 to project into a cooperative socket (not shown) in a door frame for security purposes. This deadbolt can be extended and retracted by engagement of deadbolt extension 21 (FIG. 2) with a pivotally shiftable radius arm 22 mounted on a swivel 24 (FIG. 2). Swivel 24 is pivotable on an axis transverse to the main dimension of subassembly 16 by rotation of an elongated, flat tailpiece driver 26 to be described more fully hereinafter. Thus, by rotation of tailpiece 26, swivel 24 is pivoted on its axis to shift radius arm 22 through an arc, which in turn shifts the extension 21 of the deadbolt 23, to extend or retract the deadbolt.

The interior lock cylinder subassembly 12 includes a conventional security ring 30 and cylinder collar 32. The exterior subassembly 14 also includes a security ring 60. The double cylinder lock is mounted on a door panel P (FIG. 2) in normal fashion, the interior security ring 30 and cylinder collar 32 being in abutment with the interior face of the door panel, and the outer security ring 60 being in abutment with the outer face of the panel, the operative mechanism between them extending through a formed opening O in the door panel extending between the inner and outer faces thereof, and the deadlock extending normal thereto through a second opening O' extending from opening O to the edge of the door in conventional fashion. The three subassemblies 12, 14 and 16 are secured in such relationship to each other and to the door panel by a pair of usual threaded studs 28 (FIG. 1) which extend from inner subassembly 12 into threaded engagement with a pair of interiorly threaded bosses 29 integral with the exterior subassembly.

Retained within security ring 60 is a conventional key-type lock cylinder 62 having a plurality of aligned, radially oriented tumblers 64 prearranged to be cooperative with a particular pattern of a key 66 such that, with insertion of the key, the tumblers will disengage the cylinder housing and allow the lock cylinder to be rotated by the key. This exterior cylinder allows the key 66 to be retracted in locked or unlocked condition, i.e. whether the deadbolt is extended or retracted.

The interior security ring 30 retains a second key-type lock cylinder 34. Its plurality of aligned tumblers 36 cooperate with key 66*a* of like pattern to key 66 so that the same key can be used to operate the interior or exterior cylinders of the door. Tumblers 36 cooperate with the housing of the interior lock cylinder in a way to allow key 66*a* to be retracted when the lock is in the unlocked condition, i.e. when the key cylinder is in one particular rotational position, but prevent its retraction when the lock is in locked condition, i.e. in any other rotational position. This retraction is achieved by having escapement openings 38 (FIG. 3) through which the tumblers can shift under the camming action of the configurated teeth of the key as the key is retracted when the tumblers are in the rotary position aligned with these openings 38. When, however, the lock cylinder and tumblers are rotated to any other position, the tumblers 36 are not aligned with the respective openings 38 and their outer ends abut the inner peripheral wall of housing 40 of the cylinder. The tumblers therefore cannot shift radially of the lock and therefore prevent the key from being retracted by engaging the teeth of the key.

The position of lug 56*b* and recess 44*a* are located circumferentially relative to the dead lock swivel 24 to allow the interior key retraction only when the deadbolt is in retracted condition.

These inner and outer key lock cylinders are specially interrelated with each other and with the deadbolt subassembly by a single tailpiece and a clutch. More specifically, positioned interiorly of the inner lock cylinder 34 and threadably attached thereto is a barrel cap 40 which houses the clutch mechanism. Fitted within the open end socket at the axial inner end of this barrel cap is, in sequential order beginning at the axial inner end of the barrel cap and proceeding toward the interior lock cylinder, a retainer washer 42 (FIGS. 2 and 4) spring cam 44, tailpiece driver bearing 50, disengagement spring 54, and spring driver 56. Extending between the end of the key cylinder and spring driver 66 is a driver pusher 70.

During assembly of these components, driver pusher 70 is inserted in a transverse slot 35 of the rotational interior lock cylinder and then barrel cap 40 is threaded onto the lock cylinder. The spring driver 56, disengagement spring 54, tailpiece driver bearing 50, spring cam 44 and retainer washer 42 are inserted in the outer recess of the barrel cap and the periphery of the barrel cap is then spun or otherwise deformed over the retaining washer 42 at 40′ (FIG. 2) to retain these components. A conventional anchor pin 72 and its biasing spring 74 adjusts the barrel cap in usual fashion, such forming no part of the present invention. Opening 56′ of driver 56 is an access hole needed to depress anchor pin 72 when rekeying. The axially outer end portion of flat driver pusher 70 has a recess 70*a* to receive the nose at the inner end of key 66*a* (FIG. 2). The axially inner end of pusher 70 has a nose 70*b* polygonal, i.e. rectangular, in cross section and interfitted with a like configurated slot 56*a* in the spring driver cup such that rotation of driver pusher 70 with rotation of key cylinder 34 also causes rotation of spring driver 56. At the inner end of spring driver 56, at one circumferential portion of the rim thereof, is an axially protruding engagement lug 56*b*, the rim of the spring driver extending axially toward the spring cam 44, past the smaller diameter tailpiece driver bearing 50 to engage selectively with the spring cam. Spring cam disc 44 and tailpiece driver bearing 50 are biased away from, i.e. out of engagement with, spring driver 56 by a compression coil spring 54 which serves as a disengagement spring. All of these elements are axially aligned on rotary axis A. Basically, therefore, spring driver 56 forms one component of a clutch, being rotationally driven by the key cylinder 34 by means of driver pusher 70 interengaged therebetween. The other part of the clutch is chiefly formed by the spring cam 44. This spring cam and the tailpiece driver bearing 50 are engaged with the protruding end of the tailpiece 26 to rotate therewith. This tailpiece is more elongated than a conventional tailpiece. That is, rather than terminating at the swivel 24 as a conventional tailpiece would, it extends through the swivel and into engagement with the axis of spring cam 44 and bearing 50. The outer end of the tailpiece 26 is radially offset (FIG. 2) in usual fashion, being retained by cap 90 on the inner axial end of the outer key cylinder 62 to be rotated thereby. The inner end of the tailpiece is rectangular in cross section, basically flat, with an opening 44′ in spring cam 44 being of like configuration, as is opening 50′ in tailpiece driver bearing 50. Thus, rotation of the outer cylinder and the tailpiece causes rotation of elements 44 and 50, and likewise rotation of spring cam 44 causes rotation of tailpiece 26 and the outer cylinder.

In the outer peripheral portion of spring cam disc 44 is a recess 44*a* (FIG. 10) which is radially offset from the rotational axis A (FIG. 4) the same amount as the radial offset of lug 56*b* of spring driver 56. Further, recess 44*a* has a width sufficient to receive lug 56*b*. Straddling recess 44*a* is a pair of abutment surfaces on the pair of ears 44*b*, to engage with the respective side walls of lug 56*b*. These ears are axially offset from the plane of disc 44, but are integral with the disc. The ears and disc are formed of a resilient material capable of repeated deformation without breaking, e.g. phosphor bronze. The ears can be depressed to the plane of the disc by axially directed force. They are inherently resilient so that, when temporarily deformed toward the plane of the disc and upon release of the force, will spring back to the initial position depicted.

The clutch elements or members can be drivingly engaged only at one particular rotational relationship therebetween when the lug 56*b* is aligned with recess 44*a* to axially extend into it. When the clutch elements 44 and 56 are interengaged (FIG. 2), so that lug 56*b* is engaged between ears 44*b* in recess 44*a*, rotation of either of the key cylinders will cause rotation of the tailpiece and of deadbolt swivel 24. Normally, clutch components 44 and 56 are biased out of engagement (FIG. 3) because of the inherent bias of compression disengagement spring 54 which biases these elements away from each other axially of the assembly. This biasing force causes the spring driver 56 to be shifted axially toward the inner key cylinder. This spring driver and driver pusher 70 are axially movable toward spring disc 44 and away from inner key cylinder 34 by a key in a manner to be explained, or alternatively away from the spring disc and toward the key cylinder by the biasing force of disengagment spring 54.

Swivel 24 for the dead lock is operable directly from the exterior key cylinder, using a key 66, by rotation of the key cylinder and tailpiece 26, to operate the deadbolt for extension or retraction. On the other hand, swivel 24 is indirectly operable from the interior key cylinder using key 66*a* through the clutch mechanism when engaged. The clutch mechanism is engaged by insertion of key 66*a* fully into the inner cylinder, the last portion of the insertion being forcefully made and held to cause the nose of the key to press and shift driver pusher 70 at recess 70*a*. By shifting it axially toward the swivel, this also shifts spring driver 56 by the engagement of shoulders 70*c* against face 56*c* (FIG. 2) of spring driver cup 56. The spring driver is thus axially shifted to place lug 56*b* into the same plane as the ears 44*b* of spring cam disc 44. Assuming for the moment that the lug is axially aligned with recess 44*a* when this is done, rotation of the interior key cylinder by key 66*a* will thus cause key cylinder 34 to rotate driver pusher 70 because of the interfit of the driver pusher with slot 35, the driver pusher rotating spring driver 56 because of the interengagement of nose 70*b* with like configurated opening 56*a*, to rotate lug 56*b* and thus the interengaged spring disc 44, which in turn rotates tailpiece 26 for rotation of swivel 24 to operate the deadbolt in retraction or extension.

When inner key 66*a* is so inserted, if inner cylinder 34 is rotated to lock the deadbolt, the inner key cannot be retracted because the tumblers 36 are in alignment with the openings 38 only when the deadbolt is in the unlocked position. The presence of the inner key in the inner key cylinder does not however hinder the operation of the outer cylinder by a separate like key. If the lock is shifted to the extended locked condition by a key on the outside, such that rotation of the spring cam 44 with the tailpiece 26 moves the recess 44*a* out of axial alignment with the lug 56*b* disengaged therefrom, this does not prevent effective operation of the lock subsequently by a key to be inserted into the inner cylinder. This is so because, with insertion of the inner key and thereby axial shifting of driver pusher 70 and spring driver 56 toward spring cam 44, lug 56*b* will engage the peripheral portion of the spring cam 44 generally opposite the position of recess 44*a* and, with rotation of the key cylinder, driver pusher, and spring driver as well as lug 56*b*, the lug will momentarily depress one or the other of the ears 44*b*, depending upon which way the mechanism is rotated, until it becomes aligned with recess 44*a*. At that time the depressed ear 44*b* will spring back to its offset position due to its inherent bias. The unit is then ready for actuation of the dead lock by the inner key cylinder and key in the manner explained above.

This unique arrangement of the single tailpiece actuator and clutch mechanism prevents the inner cylinder from ever becoming "out of time". The inner key is always retractable, i.e. removable, when the interior key cylinder is in the unlocked position, and is never retractable or removable when the inner key cylinder is in the locked condition.

The embodiments of the invention in which an exclusive property or privilege is claimed are defined as follows:

1. A double cylinder lock assembly having means for extending and retracting a bolt, and interior and exterior key cylinders on opposite sides of said means, comprising:

a tailpiece driver extending from one of said key cylinders through said means in operative engagment therewith toward said other key cylinder; an engageable clutch between said tailpiece driver and said other key cylinder; said clutch including a pair of disengageable drive members, one of which is engaged by said tailpiece driver and the second of which is shiftable by a key in said other key cylinder into drive engagement with said one member; said second member having a drive lug; and said one member having biased portions shiftable against the bias thereof by rotary movement of said drive lug for selective rotary drive engagement between said members.

2. The lock assembly in claim 1 wherein said one member comprises a disc with a slot to receive said drive lug, straddled by a pair of resilient ears forming said

3. The lock assembly in claim 1 including biasing means for normally retaining said members axially apart in disengaged condition, and said second member being axially shiftable against said biasing means by a key, into engaged condition, and said assembly including a pusher element engageable by a key and operable on said second member, to allow said key to shift said second member against said biasing means.

4. A double cylinder lock assembly having a pair of key cylinders and a deadbolt latch subassembly with an operating swivel comprising:

a rotary driver extending from one of said key cylinders to said lock swivel to operate it, and beyond said lock swivel toward the second key cylinder; an axially shiftable rotary clutch between said second key cylinder and said rotary driver, said clutch being normally biased to disengaged condition and being shiftable by a key in said second key cylinder to an engaged condition to operate said lock; said clutch including a pair of elements having rotary drive means axially engageable when rotationally aligned, said rotary drive means on one of said elements having resilient portions axially shiftable momentarily by rotary movement of the rotary drive means on the other element when not rotationally aligned, to allow alignment therebetween.

5. The assembly in claim 4 wherein said rotary drive means of said other element comprises an axially extending driving lug and the said one element has means to receive said lug for rotation therewith when said elements are rotationally aligned.

6. A double cylinder lock assembly having swivel means for extending and retracting a lock bolt, and interior and exterior rotary key cylinders on opposite sides of said swivel means to extend and retract said lock bolt, said interior key cylinder having key retraction capacity in a particular rotary position with said lock bolt retracted, comprising:

a rotary driver extending from said exterior key cylinder into operative engagement with said swivel means and toward said interior key cylinder; an axially shiftable, rotary clutch between said rotary driver and said interior key cylinder, having a pair of engageable members, and shiftable by a key in said interior key cylinder to engaged condition from a normally disengaged condition; and said clutch being engageable in only one rotational relationship between said members to assure retractability of the key from said interior key cylinder at said particular rotary position with said lock bolt retracted, and prevent retractability of such key at other rotary positions thereof, one of said clutch members comprising a disc engaged by said rotary driver and having a radially offset recess straddled by a pair of abutment surfaces, and the other of said clutch members having a lug which is axially shiftable by a key in said interior key cylinder into drive engagement with said recess, said abutment surfaces being portions of a pair of resilient ears protruding axially from said disc and depressable by said lug against inherent bias for alignment of said lug and said recess.

* * * * *

UNITED STATES PATENT AND TRADEMARK OFFICE

CERTIFICATE OF CORRECTION

PATENT NO. : 4,228,669

DATED : October 21, 1980

INVENTOR(S) : Daniel R. Bischoff

It is certified that error appears in the above–identified patent and that said Letters Patent are hereby corrected as shown below:

Column 1, line 12:

"dobule" should be ---double---

Column 6, line 8:

After "said" insert ---biased portions.---

Signed and Sealed this

Tenth Day of March 1981

[SEAL]

*Attest:*

RENE D. TEGTMEYER

*Attesting Officer*

*Acting Commissioner of Patents and Trademarks*